US008768204B2

(12) United States Patent
Tomatsu et al.

(10) Patent No.: US 8,768,204 B2
(45) Date of Patent: Jul. 1, 2014

(54) IMAGE FORMING DEVICE PROVIDED WITH SIDE WALLS HAVING EMPTY REGION

(75) Inventors: Yoshiya Tomatsu, Kasugai (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 28 days.

(21) Appl. No.: 13/352,375

(22) Filed: Jan. 18, 2012

(65) Prior Publication Data

US 2012/0251163 A1 Oct. 4, 2012

(30) Foreign Application Priority Data

Mar. 30, 2011 (JP) ..... 2011-076280

(51) Int. Cl.
*G03G 15/00* (2006.01)

(52) U.S. Cl.
USPC ..... 399/110; 399/116; 399/117

(58) Field of Classification Search
USPC ..... 399/110, 116, 117
See application file for complete search history.

(56) References Cited

U.S. PATENT DOCUMENTS

| | | | | |
|---|---|---|---|---|
| 5,475,484 | A * | 12/1995 | Kimura | 399/130 |
| 5,552,857 | A | 9/1996 | Ishikawa | |
| 7,991,323 | B2 | 8/2011 | Hashimoto | |
| 2009/0092414 | A1 * | 4/2009 | Tomatsu | 399/117 |
| 2009/0220274 | A1 | 9/2009 | Hashimoto | |
| 2009/0220275 | A1 | 9/2009 | Hashimoto | |
| 2009/0245859 | A1 * | 10/2009 | Okabe | 399/117 |
| 2010/0329757 | A1 | 12/2010 | Souda | |

FOREIGN PATENT DOCUMENTS

| | | | |
|---|---|---|---|
| JP | 06-332270 | A | 12/1994 |
| JP | H07-311500 | A | 11/1995 |
| JP | 2009-210629 | A | 9/2009 |
| JP | 2009-210630 | | 9/2009 |

OTHER PUBLICATIONS

Office Action issued in Japanese Patent Application No. 2011-076280 mailed Mar. 5, 2013.
Extended European Search Report issued in corresponding European Application No. 12151353.5 dated Jan. 29, 2014.
First Office Action issued in corresponding Chinese Patent Application No. 201210021238.3 mailed Apr. 29, 2014.

* cited by examiner

*Primary Examiner* — Clayton E Laballe
*Assistant Examiner* — Jas Sanghera
(74) *Attorney, Agent, or Firm* — Banner & Witcoff, Ltd.

(57) ABSTRACT

An image forming device includes a main casing and a photosensitive unit having photosensitive bodies arrayed in an array direction. The main casing includes a first side plate having a first primary portion extending in the array direction, and having a first positioning portion and a second positioning portion spaced away therefrom in the array direction. The photosensitive unit includes a second side plate supporting the photosensitive bodies and having a second primary portion extending in the array direction. The second side plate has a third positioning portion subjected to positioning relative to the first positioning portion and has a fourth positioning portion subjected to positioning relative to the second positioning portion. The first and third portions are overlapped with each other and the second and fourth positioning portions are overlapped with each other while the first primary portion and the second primary portion are spaced away from each other.

9 Claims, 8 Drawing Sheets

IMAGE FORMING DEVICE PROVIDED WITH SIDE WALLS HAVING EMPTY REGION

CROSS REFERENCE TO RELATED APPLICATION

This application claims priority from Japanese Patent Application No. 2011-076280 filed Mar. 30, 2011. The entire content of this application is incorporated herein by reference.

TECHNICAL FIELD

The present invention relates to an electro-photographic type image forming device.

BACKGROUND

Tandem-type electro-photographic color printers are well known in the art. A tandem-type color printer has four photosensitive drums for the colors yellow, magenta, cyan, and black, for example, the four photosensitive drums being disposed parallel to one another in a tandem arrangement.

The color printer includes a main frame, a drum support unit, and a scanner unit. The main frame is made from a metal and has a pair of side wall portions confronting with each other. The drum support unit is movable relative to the main frame for supporting the photosensitive drums of respective colors. The scanner unit is positioned above the drum support unit and is supported to upper end portions of the side wall portions for irradiating light to the respective photosensitive drums.

A positioning member extends between the rear end portions of the side wall portions, and an insertion groove is formed at each front end portion of each side wall portion. The drum support unit has a front end portion formed with a positioning recess engageable with the positioning member, and has a rear end portion provided with a linking member. The linking member has protruding end portions engageable with the insertion grooves. Thus, the drum support unit can be positioned relative to the main frame.

SUMMARY

According to such conventional color printer, the side wall portions must support the scanner unit, and at the same time, the side wall portions must perform positioning of the drum support unit. To this effect, an entire area of each side portion of the printer must be occupied with a solid member or plate without any hole. Consequently, light-weight and low cost main frame cannot be provided, and accordingly, a light-weight and low cost printer cannot be provided.

It is an object of the present invention to provide a light-weight and low cost image forming device.

This and other objects of the present invention will be attained by and image forming device. The image forming device includes a main casing, a plurality of photosensitive bodies, a photosensitive unit, an exposure unit. The plurality of photosensitive bodies each defines a longitudinal direction, and is arrayed with a space between neighboring photosensitive bodies in an array direction perpendicular to the longitudinal direction. The photosensitive unit is movable relative to the main casing and includes the plurality of photosensitive bodies. The exposure unit is disposed in the main casing and confronts the photosensitive unit in a confronting direction perpendicular to the longitudinal direction and the array direction. The exposure unit is configured to expose the photosensitive bodies to light. The main casing includes a first side plate supporting the exposure unit and having a first primary portion extending in the array direction. The first side plate also has a first positioning portion and a second positioning portion spaced away from the first positioning portion in the array direction. The photosensitive unit includes a second side plate supporting the photosensitive bodies and having a second primary portion extending in the array direction. The second side plate also has a third positioning portion subjected to positioning relative to the first positioning portion, and a fourth positioning portion subjected to positioning relative to the second positioning portion. The first positioning portion and the third positioning portion is overlapped with each other and the second positioning portion and the fourth positioning portion is overlapped with each other in the longitudinal direction while the first primary portion and the second primary portion is spaced away from each other.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a color printer as one embodiment of the present invention will be described with reference to FIGS. 1 through 6.

1. Overall Structure of a Color Printer

Figure 1:
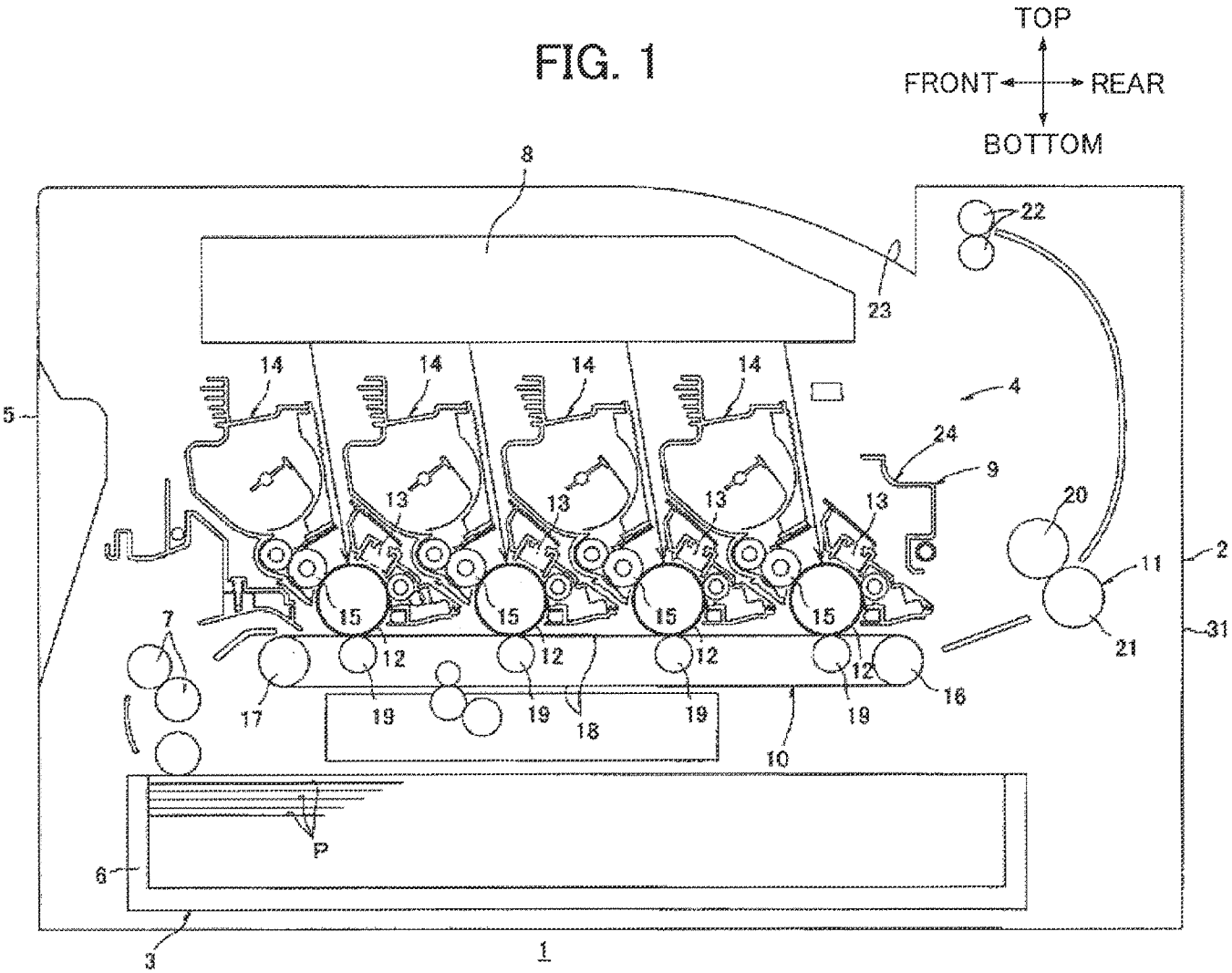
FIG. 1 is a schematic cross-sectional view of a color printer according to a first embodiment of the present invention.

As shown in FIG. 1, a direct tandem-type color printer 1 of transverse-mounted type is the embodiment of the image forming device. This color printer 1 includes a main casing 2, a sheet supply unit 3 for supplying a sheet P, and an image forming unit 4 for forming an image on the supplied sheet P.

(1) Main Casing

The main casing 2 is box shaped and has a rectangular shape in side view for accommodating therein the sheet supply unit 3 and the image forming unit 4. A front cover 5 is disposed on one side wall of the main casing 2. The front cover 5 has a lower end portion pivotally movably connected to the main casing 2. A process unit 9 (described later) is accessible upon opening the front cover 5.

In the following description, the side of the main casing 2 on which the front cover 5 is provided (the left side in FIG. 1) will be referred to as a "front side," and the opposite side (the right side in FIG. 1) will be referred to as a "rear side." Further, the left and right sides of the main casing 2 will be based on the perspective of a user looking at the color printer 1 from the front side.

(2) Sheet Supply Unit

The sheet supply unit 3 includes a sheet supply tray 6 which is disposed in a lower section of the main casing 2 for accommodating the sheets P. The color printer 1 also includes a pair of registration rollers 7 disposed above a front end portion of the sheet supply tray 6.

Each sheet P accommodated in the sheet supply tray 6 is supplied to a position between the registration rollers 7, and further to the image forming unit 4 (more precisely to a position between a photosensitive drum 12 (described later) and a conveying belt 18 (described later)) at a predetermined timing.

(3) Image Forming Unit

The image forming unit 4 includes a scanner unit 8, the process unit 9 as a photosensitive unit, a transfer unit 10, and a fixing unit 11.

(3-1) Scanner Unit

The scanner unit 8 is disposed at an upper section of the main casing 2. The scanner unit 8 is box shaped extending in frontward/rearward and leftward/rightward direction. Based on image data, the scanner unit 8 irradiates laser beams to expose four photosensitive drums 12 (described later) as indicated by solid lines shown in FIG. 1. The scanner unit 8 is in confrontation with the process unit 9 in top-to-bottom direction as a confronting direction.

(3-2) Process Unit

Figure 2:
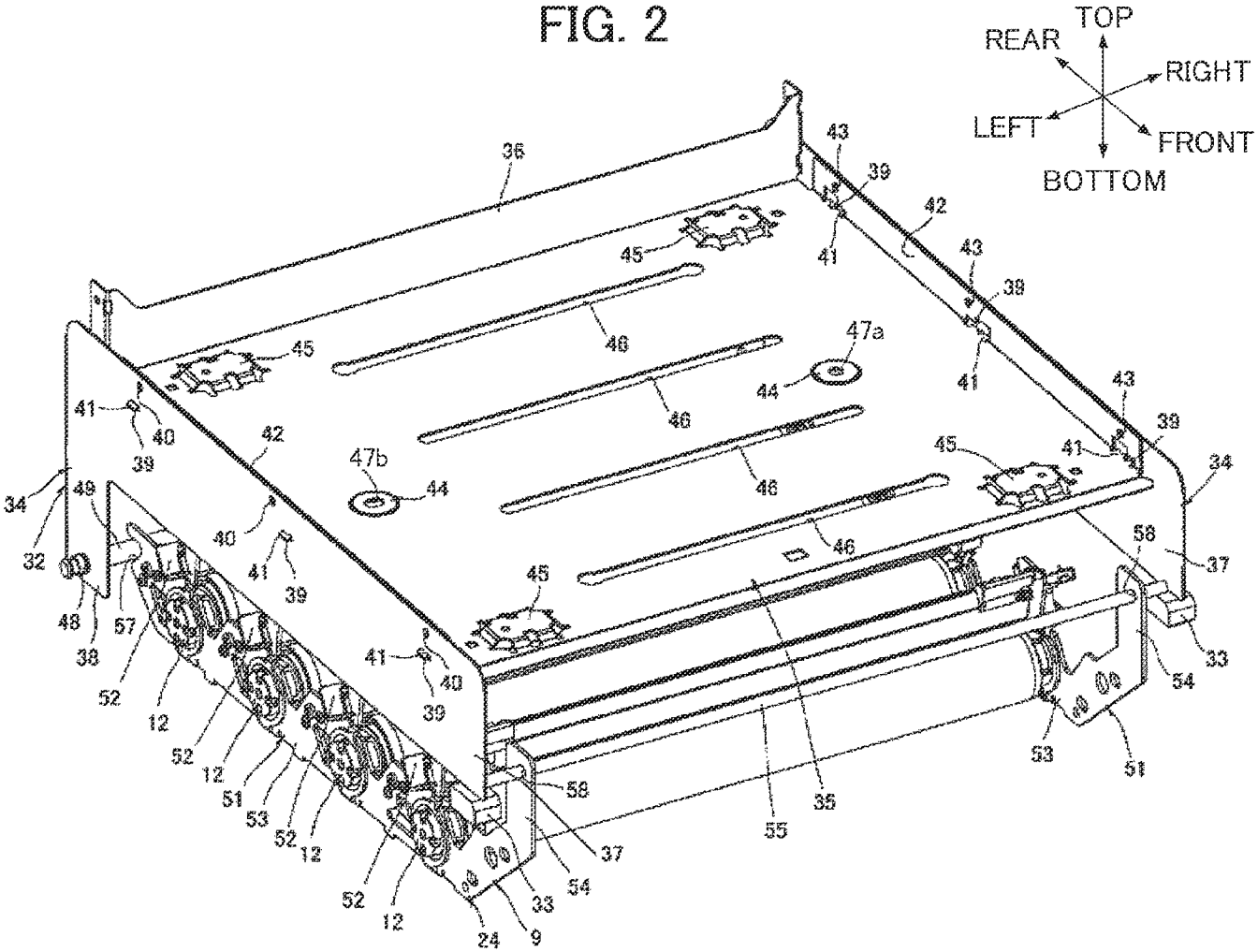
FIG. 2 is a perspective view of an inner easing of a main body casing and a drawer unit in the color printer according to the first embodiment.
Figure 6:
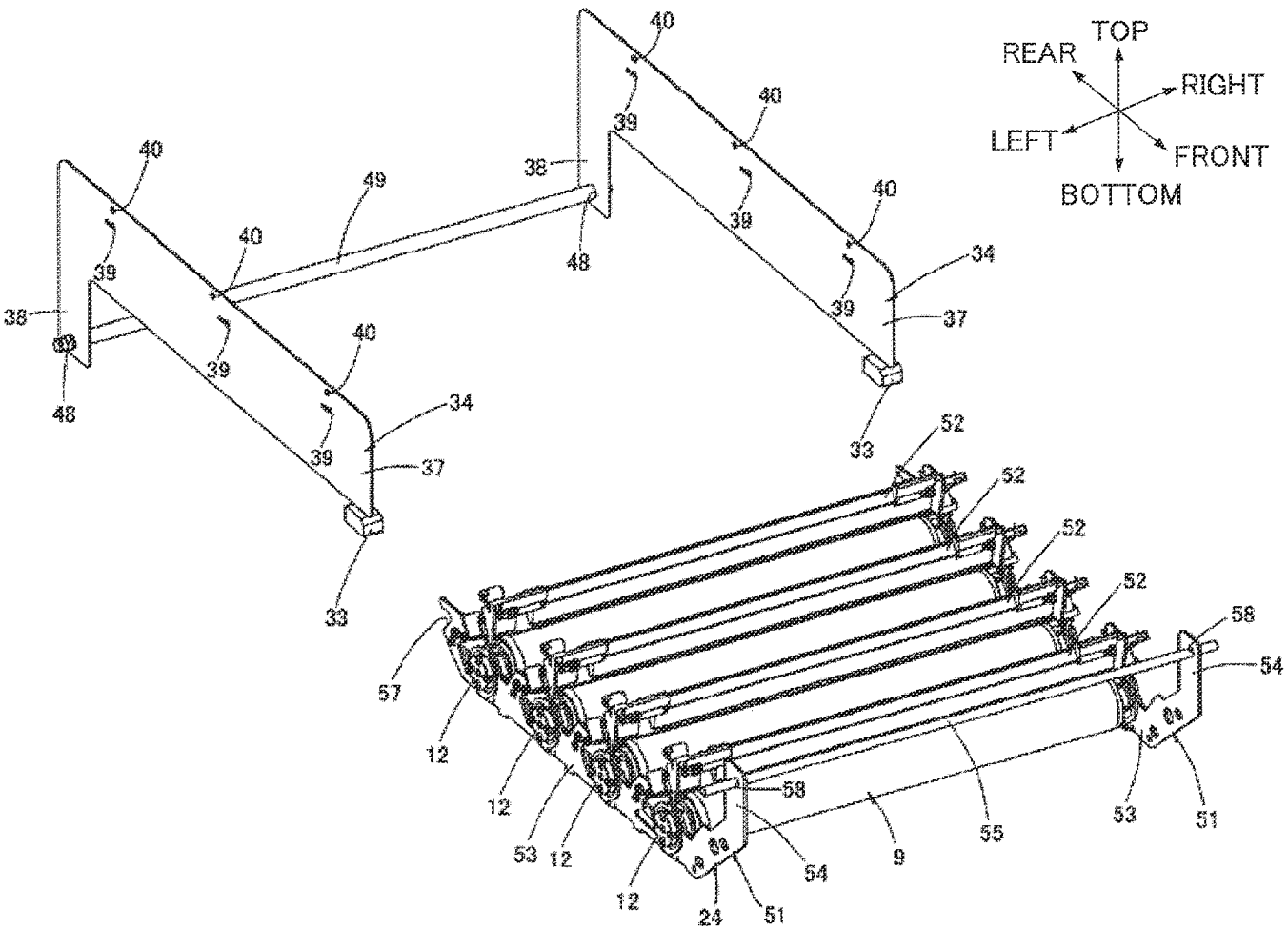
FIG. 6 is a perspective view for description of attachment and detachment of the process unit to and from the inner casing in the color printer according to the first embodiment.

The process unit 9 is disposed below the scanner unit 8 and above the transfer unit 10 and includes a drawer unit 24 and a developing unit 14. The process unit 9 is slidingly movable in frontward/rearward direction relative to the main easing 2 to an accommodated position as shown in FIG. 2 where image forming operation can be performed and to a pulled-out position as shown in FIG. 6 where the process unit 9 is partly or fully pulled out of the main casing 2.

The drawer unit 24 is slidably movable relative to the main casing 2 in the frontward/rearward direction, and is provided with the photosensitive drums 12 as photosensitive bodies and Scorotron chargers 13. The photosensitive drums 12 are cylindrical, and are juxtaposed with each other in the front-to-rear direction at fixed intervals such that each photosensitive drum 12 extends in a right-to-left or lateral direction.

Each of the Scorotron chargers 13 is disposed at a position diagonally above and rearward of the corresponding photosensitive drum 12 so as to confront the photosensitive drum 12 with a gap therebetween.

The developing units 14 have a one-on-one correspondence to the photosensitive drums 12. Each of the developing units 14 is disposed above the corresponding photosensitive drum 12, and has a developing roller 15.

The developing roller 15 is rotatably supported at the bottom of the developing unit 14 such that a rear portion of the developing roller 15 is exposed outside the developing cartridge 14 and contacts an upper front portion of the photosensitive drum 12.

The developing unit 14 has toner chambers each positioned at an upper side of each developing roller 15 for accommodating therein toner of each color.

The toner in the toner chamber is carried on an outer peripheral surface of the developing roller 15 in accordance with the rotation thereof. On the other hand, a surface of the photosensitive drum 12 is uniformly charged by the Scorotron charger 13 in association with rotation of the photosensitive drum 12. Then, the surface is subjected to high speed scan of the laser beam (indicated by the solid line) emitted from the scanner unit 1. As a result, an electrostatic latent image corresponding to an image to be formed on the sheet P is formed on the surface of the photosensitive drum 12.

When the photosensitive drum 12 further rotates, the toner deposited on the developing roller 15 is selectively supplied to the electrostatic latent image formed on the surface of the photosensitive drum 12, thereby forming a visible toner image on the surface of the photosensitive drum 12 by a reverse development.

(3-3) Transfer Unit

The transfer unit 10 is disposed above the sheet supply unit 3 and below the process unit 9 in the main casing 2 along the front-to-rear direction. The transfer unit 10 includes a drive roller 16, a driven roller 17, the conveying belt 18, and four transfer rollers 19.

The drive roller 16 and the driven roller 17 are disposed in confrontation with and spaced apart from each other in the front-to-rear direction. The conveying belt 18 is an endless belt stretched around the drive roller 16 and the driven roller 17 such that a top portion of the conveying belt 18 confronts and contacts the photosensitive drums 12. When the drive roller 16 is driven to rotate, the conveying belt 18 circulates such that the top portion of the conveying belt 18 moves rearward from the front.

Each of the transfer rollers 19 is provided at a position confronting the corresponding photosensitive drum 12, with an upper portion of the conveying belt 18 interposed therebetween.

The sheet P supplied from the sheet supply unit 3 to the image forming unit 4 is conveyed rearward by the conveying belt 18 and passes through transfer positions between the photosensitive drum 12 and the transfer roller 19 sequentially. The toner image of each color carried on the photosensitive drum 12 is transferred onto the sheet P while the sheet P is conveyed by the conveying belt 18, thereby forming a color image on the sheet P.

(3-4) Fixing Unit

The fixing unit 11 is disposed rearward and upward of the transfer belt 18, and includes a heat roller 20 and a pressure roller 21 confronting the heat roller 20. In the fixing unit 11, the color image transferred onto the sheet P is thermally fixed onto the sheet P by heat and pressure while the sheet P passes through a position between the heat roller 20 and the pressure roller 21.

(4) Discharge of Sheet

The sheet P on which the monochromatic or color image has been fixed is conveyed by discharge rollers 22 and discharged to a discharge tray 23 formed above the scanner unit 8.

2. Main Casing

The main casing 2 includes an outer casing 31 as an outer shell of the color printer 1 and an inner casing 32 as shown in FIG. 2 disposed inside the outer casing 31.

(1) Outer Casing

The outer casing 31 is generally box shaped, and has a front end portion provided with the front cover 5. Further, a positioning member 33 as shown in FIG. 2 is provided at right and left sides of the outer casing 31. Each positioning member 33 is positioned at vertically center portion of the side wall portion of the outer casing 31 and extends laterally inward from each side wall portion. Each positioning member 33 is of a generally prismatic body.

(2) Inner Casing

The inner easing 32 is formed of a metal plate, and has a generally rectangular shape with its bottom side being open. The inner casing 32 includes a pair of main side frames 34 as first side plates, a scanner support plate 35, a rear beam 36 and a base shaft 49.

The pair of main side frames 34 is produced by punching and pressing a metal plate with using an identical pressing-press die. Each main side frame 34 extends in frontward/rearward direction, and has a generally L-shape in a side view. That is, each main side frame 34 includes a first primary portion 37 and a first extension portion 38.

The first primary portion 37 extends in the frontward/rearward direction and has a rectangular shape. In a side view, the first primary portion 37 is positioned above each photosensitive drum 12 with a space therebetween. More specifically, in the side view, the first primary portion 37 is vertically spaced away from a second primary portion 53 (described later) of an inner side plate 51 (described later) that supports each photosensitive drum 12. Each first primary portion 37 has a front end portion, seated on each positioning member 33.

The first primary portion 37 is formed with three fitting holes 39 and three thread holes 40 in association with the scanner support plate 35. The three fitting holes 39 are positioned at an upper end portion of the first primary portion 37 and are arrayed in the frontward/rearward direction and at a front end portion, an intermediate portion and a rear end portion thereof, respectively. Each fitting hole 39 is elongated shaped extending in the frontward/rearward direction. Each thread hole 40 is positioned above and adjacent to each fitting hole 39. Each thread hole 40 is generally circular shaped.

The first extension portion 38 extends downward from the rear end portion of the first primary portion 37, and is rectangular shaped in side view. The first extension portion 38 is positioned rearward of a rearmost photosensitive drum 12. The first extension portion 38 has a rear end portion formed with a through-hole 48 having a generally circular shape whose diameter is greater than an outer diameter of the base shaft 49 so as to allow the base shaft 49 to extend through the through-hole 48.

The scanner support plate 35 is rectangular shaped in plan view and extends frontward/rearward and rightward/leftward. The scanner support plate 35 has each side integrally provided with three protrusions 41 and a fixing plate 42. Each protrusion 41 protrudes laterally outward from the each side of the scanner support plate 35 and has a generally rectangular shape in plan view. Each protrusion 41 has a length in the frontward/rearward direction smaller than that of the fitting hole 39. Further, each protrusion 41 has a thickness in vertical direction smaller than a vertical width of each fitting hole 39. Further, these protrusions 41 are spaced away from each other in the frontward/rearward direction so as to correspond to the three fitting holes 39.

Each fixing plate 42 extends in the frontward/rearward direction and protrudes upward from each side of the scanner support plate 35. Each fixing plate 42 is formed with three thread holes 43 at positions corresponding to the positions of the three thread holes 40 of each main side plate 34.

The protrusions 41 and the fixing plate 42 can be formed simultaneously by making cuts corresponding to the protrusions 41 in a rectangular metal plate and then bending lateral end portion upward along a line corresponding to the lateral side of the scanner support plate 35.

The scanner support plate 35 is formed with four slits 46, and has a pair of scanner-positioning portions 44 and four seat portions 45. The slits 46 are positioned at laterally center portion of the scanner support plate 35 and linearly extend in the lateral direction. Further, the slits 46 are spaced away from each other in the frontward/rearward direction such that each slit 46 is positioned in confrontation with and above each photosensitive drum 12.

The scanner positioning portions 44 are positioned at a center portion of the scanner support plate 35 in the frontward/rearward direction, and spaced away from each other in the lateral direction at positions laterally outward of the slits 46. Each scanner positioning portion 44 protrudes upward from the scanner support plate 35 and has a cylindrical shape. Further, the right positioning portion 44 is formed with a generally cylindrical recess 47*a* recessed downward, while the left positioning portion 44 is formed with a generally oblong shaped recess 47*b* recessed downward.

Each seat portion 45 is positioned at each corner portion of the scanner support plate 35, and has a rectangular column shape protruding upward from the scanner support plate 35. The scanner support plate 35 is bridged between the main side plates 34 and 34 by fitting engagement of each protrusion 41 with the fitting hole 39 and threading engagement of a male thread (not shown) with the thread holes 40 and 43 aligned with each other.

The scanner unit 8 is fixed to the scanner support plate 35 by fitting each positioning boss (not shown) of the scanner unit 8 with each recess 47 and by fixing each corner portion of the scanner unit 8 to each seat portion 45. Laser beam emitted from the scanner unit 8 passes through the slit 46 so that each photosensitive drum 12 is exposed to the laser beam.

The rear beam 36 extends in the lateral direction and has a generally plate shape and is positioned rearward of the scanner support plate 35. Each lateral end portion of the rear beam 36 is fixed to each rear upper end portion of the main side plate 34.

The base shaft 49 extends in the lateral direction and has a cylindrical bar shape. The base shaft 49 is bridged between the main side plates 34 and 34 such that each lateral end portion of the base shaft 49 is inserted through each through-hole 48.

3. Process Unit (1) Drawer Unit

The drawer unit 24 includes a generally rectangular frame body (not shown) constituted by a pair of outer side plates (not shown), a front beam (not shown) and a rear beam (not shown). The drawer unit 24 further includes, inside the rectangular frame body, a pair of inner side plates 51 as second side plates, the photosensitive drums 12, four drum sub-units 52 each corresponding to each photosensitive drum 12, and a positioning shaft 55.

Each inner side plate 51 is formed with four drum support holes 56, and the pair of inner side plates 51 confronts with each other in the lateral direction and is aligned with each other so that drum support holes 56 of one of the inner side plates 51 are aligned with the drum support holes 56 of the other inner side plate 51 in the lateral direction. Further, the inner side plates 51 are produced by punching and pressing a metal plate with an identical punching-press die. Each inner side plate 51 extends in the frontward/rearward direction and has a front end portion bent upward to form generally L-shape in side view. More specifically, each inner side plate 51 includes the second primary portion 53 and a second extension portion 54 integrally therewith.

The second primary portion 53 extends in frontward/rearward direction and is rectangular shaped in side view. The second primary portion 53 has a vertical length approximately equal to the diameter of the photosensitive drum 12, and is formed with four drum support holes 56 and a notched portion 57.

The drum support holes 56 are circular in shape in side view, and are arrayed in frontward/rearward direction with a constant interval. The notched portion 57 is V-shaped such that an open end of the notched portion 57 is at a rear end of the second primary portion 53 and a bottom of the V-shape is positioned frontward of the open end. The notched portion 57 is adapted to receive the base shaft 49 of the main casing side when the process unit 9 is assembled to the main easing 2 as shown in FIG. 2.

The second extension portion 54 extends upward from a front end portion of the second primary portion 53, and has a rectangular shape in side view. A shaft insertion hole 58 having generally circular shape in side view is formed at an upper end portion of the second extension portion 54. The shaft insertion hole 58 has an inner diameter greater than an outer diameter of the positioning shaft 55 for allowing the positioning shaft 55 to be inserted therethrough.

Each photosensitive drum 12 extends in the lateral direction and has a cylindrical shape. Each lateral end portion of each photosensitive drum 12 is rotatably supported to each drum support hole 56. Incidentally, the left end portion of each photosensitive drum 12 is adapted to fit with a male coupling member (not shown) of the main casing 2.

The drum sub-unit 52 extends in the lateral direction and has a triangular prism shape. Four drum sub-units 52 are arrayed in the frontward/rearward direction with a constant interval so that each drum sub-unit 52 is positioned rearward of each photosensitive drum 12. Each Scorotron charger 13 is juxtaposed with and held to each drum sub-unit 52.

The positioning shaft 55 extends in the lateral direction and is generally cylindrical shaped. The positioning shaft 55 is spanned between the inner side plates 51, such that each end portion of the positioning shaft 55 is inserted through each shaft insertion hole 58. Further, the each end portion of the positioning shaft 55 protrudes laterally outward of the drawer unit 24.

(2) Positioning of Process Unit

Figure 3:
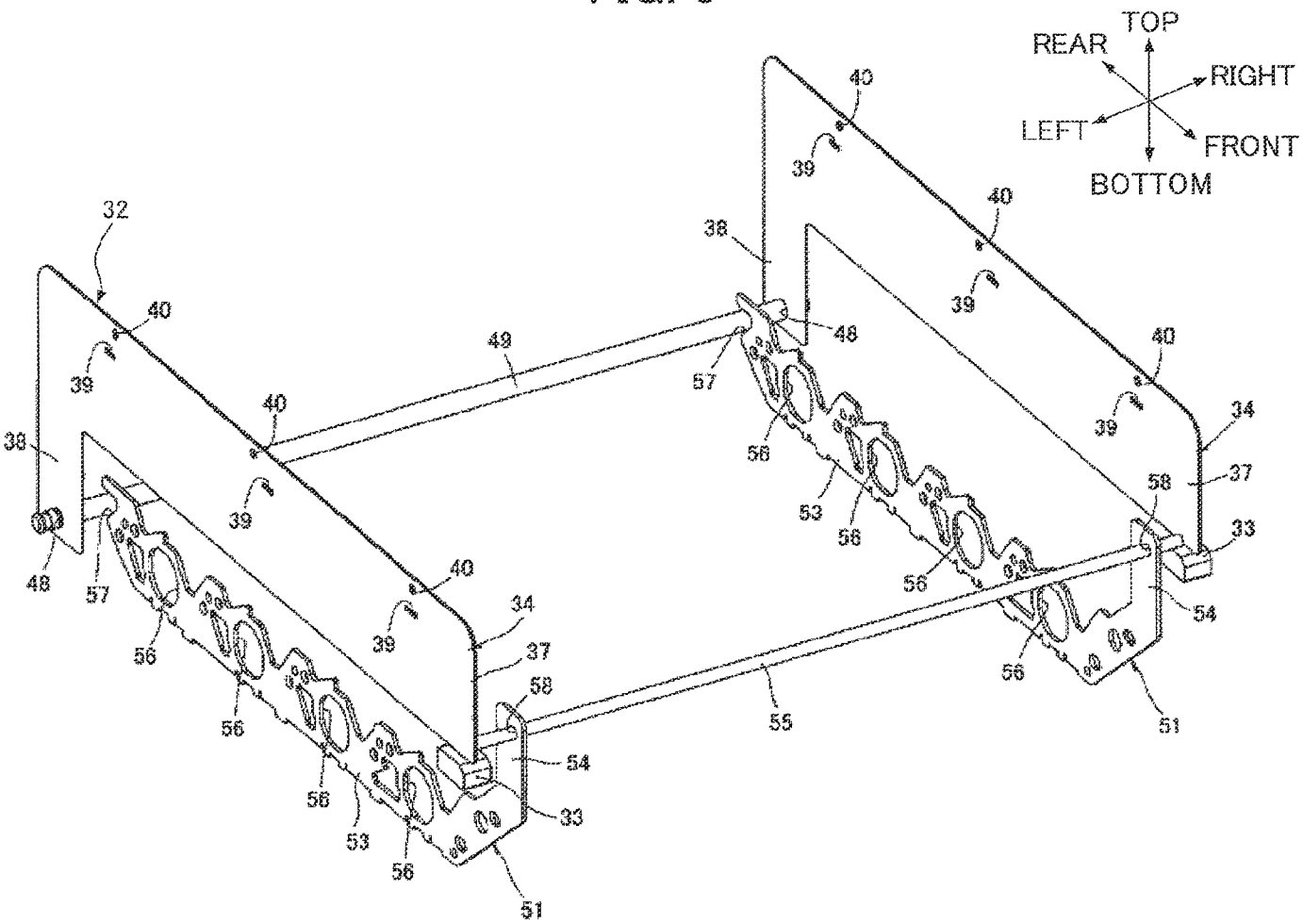
FIG. 3 is a perspective view as viewed from upper left side for description of positioning the drawer unit to the inner casing in the color printer according to the first embodiment.
Figure 4:
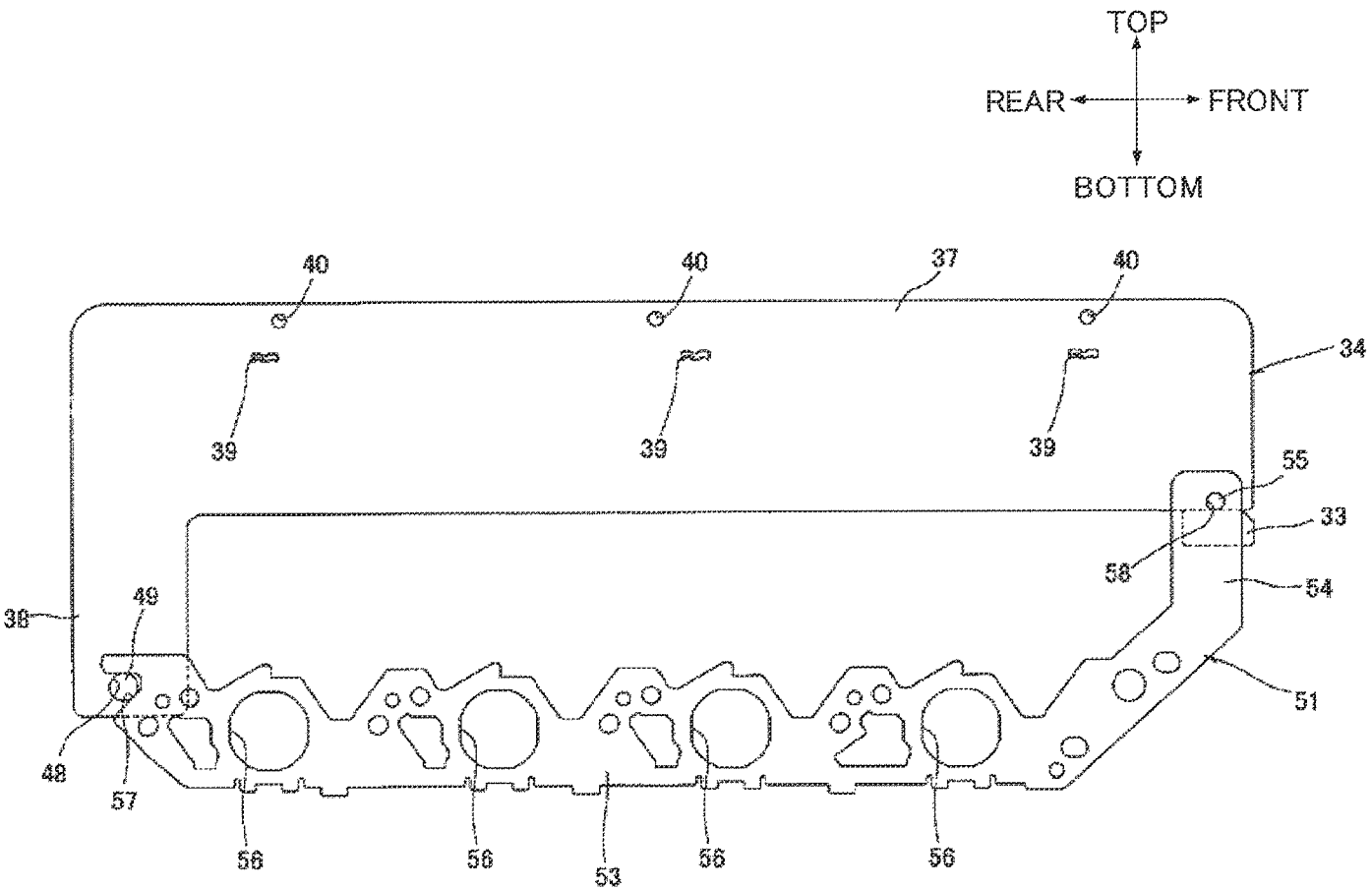
FIG. 4 is a side view as viewed from a left side for description of positioning the drawer unit to the inner casing in the color printer according to the first embodiment.

As shown in FIGS. 3 and 4, positioning of the rear end portion of the process unit 9 relative to the inner casing 32 is achieved by fitting the notched portion 57 with the base shaft 49. Further, the front end portion of the process unit 9 is abutted on the positioning members 33 from above. That is, each end portion of the positioning shaft 55 is abutted on each positioning member 33. In other words, the front end portion of the first primary portion 37 (main casing side) and the each end portion of the positioning shaft 55 (process unit side) are both abutted on the upper surface of the positioning member 33. Thus, positioning of the front end portion of the process unit 9 relative to the inner casing 32 is achieved through the positioning members 33.

In other words, in the main side plate 34, the lower end portion of the first extension portion 38 through which the base shaft 49 extends functions as a first positioning portion, and the front end portion of the first primary portion 37 functions as a second positioning portion. Further, in the inner side plate 51, the rear end portion of the second primary portion 53 at which the notched portion 57 is formed functions as a third positioning portion in association with the lower end portion of the first extension portion 38, and the upper end portion of the second extension portion 54 through which the positioning shaft 55 extends functions as a fourth positioning portion in association with the front end portion of the first primary portion 37.

In a side view, the first primary portion 37 and the second primary portion 53 are spaced away from each other in the vertical direction avoiding mutual overlapping, the lower end portion of the first extension portion 38 and the rear end portion of the second primary portion 53 are overlapped with each other, and the front end portion of the first primary portion 37 and the upper end portion of the second extension portion 54 are overlapped with each other.

With this structure, a compact printer can be provided such that overlapping between the main side plate 34 and the inner side plate 51 is prevented while the main side plate 34 and the inner side plate 51 are subjected to positioning relative to each other. Consequently, light-weight and low cost printer can be provided. That is, a non-overlapping between the main side plate 34 and the inner side plate 51 provides an empty region in the side wall area, thereby reducing weight and cost.

Further, as shown in FIG. 4, because the second extension portion 54 is provided extending upward from the front end portion of the second primary portion 53, the an extension portion extending downward from the front end portion of the main side plate 34 is not required, yet performing positioning of the front end portion of the second extension portion 54 relative to the front end portion of the main side plate 34. This also leads to downsizing of the main side plate 34, leading to the light-weight and low cost printer.

Further, since the main side plate 34 is L-shaped in side view, an area of the main side plate 34 can be reduced at the first primary portion 37, i.e., at a portion frontward of the first extension portion 38.

Further, the rear end portion of the second primary portion 53 can be subjected to positioning relative to the lower end portion of the first extension portion 38 by the fitting engagement of the notched portion 57 with the base shaft 49. Therefore, such positioning can be achieved stably with a simple construction.

Further, the front end portion of the first primary portion 37 of the main side plate 34 and each lateral end portion of the positioning shaft 55 are seated on the upper end surface of the positioning member 33 of the main casing 2 as shown in FIG. 3. In other words, relative positioning between the front end portion of the first primary portion 37 and the upper end portion of the second extension portion 54 can be attained by the common positioning member 33. Therefore, such positioning can be achieved stably with the simple construction.

Figure 5:
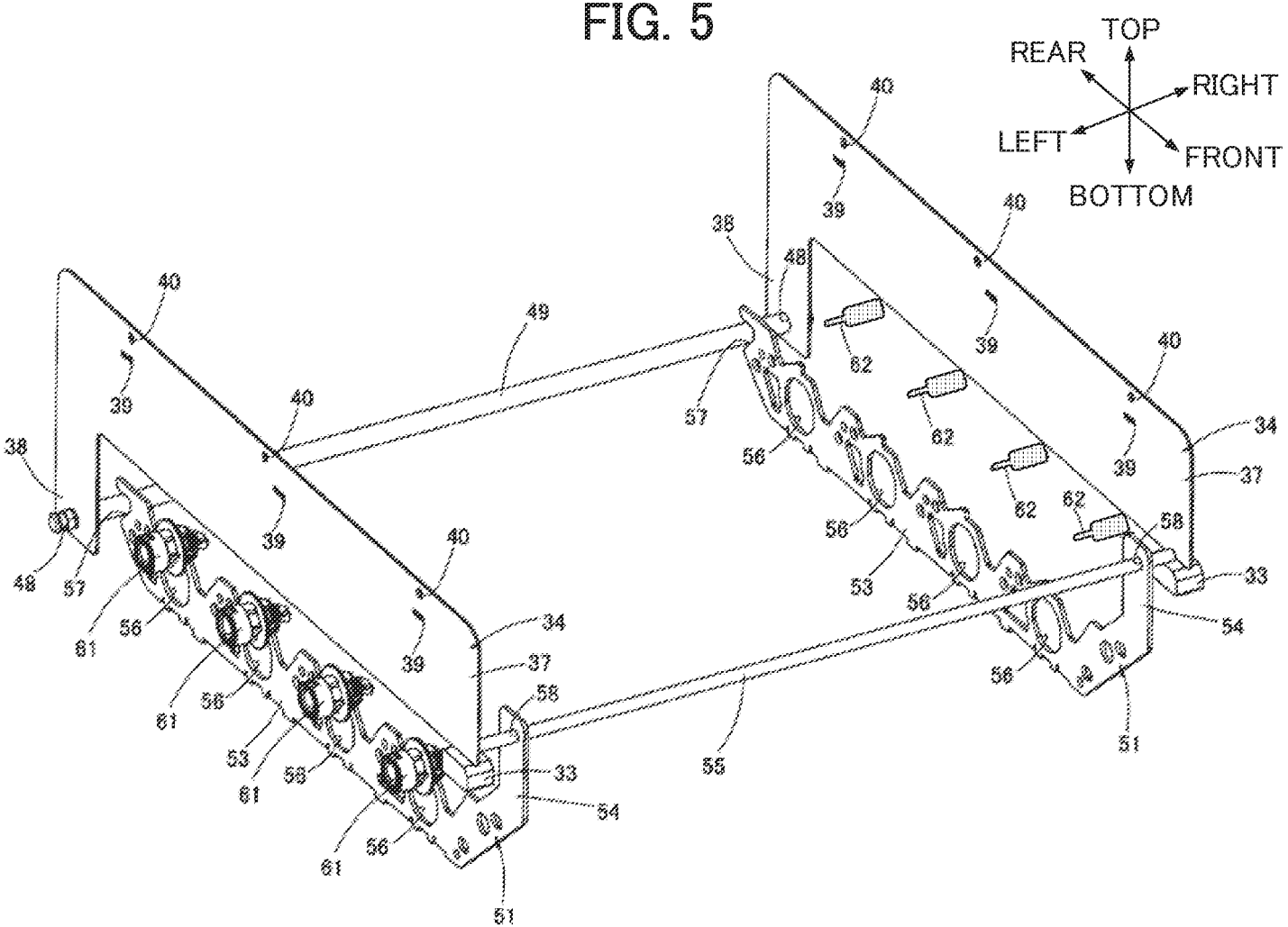
FIG. 5 is a perspective view for description of electrical power supply to a process unit and input of driving a developing unit in the color printer according to the first embodiment.

(3) Electrical Power Supply to Process Unit & Driving Force Input to Developing Unit As shown in FIG. 5, in the main casing 2, main casing side couplings 61 as driving force input portions and a main casing side electrodes 62 as power feed portions are provided.

The couplings 61 are positioned at the left side of the developing units 14, and between the first primary portion 37 and the second primary portion 53 in side view. These couplings 61 are moved toward coupling members (not shown) of the developing units 14 in interlocking relation to the closing movement of the front cover 5, and are coupled to the coupling members (not shown) of the developing unit 14 avoiding relative rotation therebetween, after the process unit 9 is assembled to the main easing 2. Driving force from a drive source (not shown) in the main casing 2 can be transmitted to the developing unit 14 through the couplings 61. Further, the couplings 61 are moved away from the coupling members in interlocking relation to the opening movement of the front cover 5, to release the coupling 61 to the coupling members.

Since the couplings 61 are positioned between the first primary portion 37 and the second primary portion 53, a space defined between the first and second primary portions 37 and 53 can be utilized effectively for the layout of these couplings 61.

The electrodes 62 are positioned at the right side of the process unit 9 and between the first primary portion 37 and the second primary portion 53 in side view. These electrodes 62 are normally urged leftward such that these electrodes 62 can be moved toward electrodes (not shown) of the process unit 9 and in electrical contact therewith upon completion of assembly of the process unit 9 into the main casing 2. Electric power supplied from a power source (not shown) in the main casing 2 is supplied to the process unit 9 through the electrodes 62, and is supplied to the developing unit 14 and the Scorotron charger 13 through a wiring (not shown).

Since the electrodes 62 are positioned between the first primary portion 37 and the second primary portion 53, a space defined between the first and second primary portions 37 and 53 can be utilized effectively for the layout of these electrodes 62.

(4) Attachment and Detachment of Process Unit

The process unit 9 can be moved to the pulled out position by opening the front cover 5 and pulling the process unit 9 frontward relative to the main casing 2. Further, the process unit 9 can be moved to the accommodating position by pushing the process unit 9 into the main casing 2, and is then subjected to positioning relative to the main casing 2 as described above.

With this structure, attachment and detachment of the process cartridge 9 relative to the main casing 2 can be easily performed.

4. Second Embodiment

A color printer according to a second embodiment of the present invention will be described with reference to FIG. 7 wherein like parts and components are designated by the same reference numerals as those shown in FIGS. 1 through 6. In the printer according to the first embodiment, relative positioning between the front end portion of the first primary portion 37 and the upper end portion of the second extension portion 54 is achieved through the positioning member 33 by seating the front end portion of the first primary portion 37 and the lateral end portion of the positioning shaft 55 on the upper surface of the positioning member 33 of the main casing 2.

Figure 7:
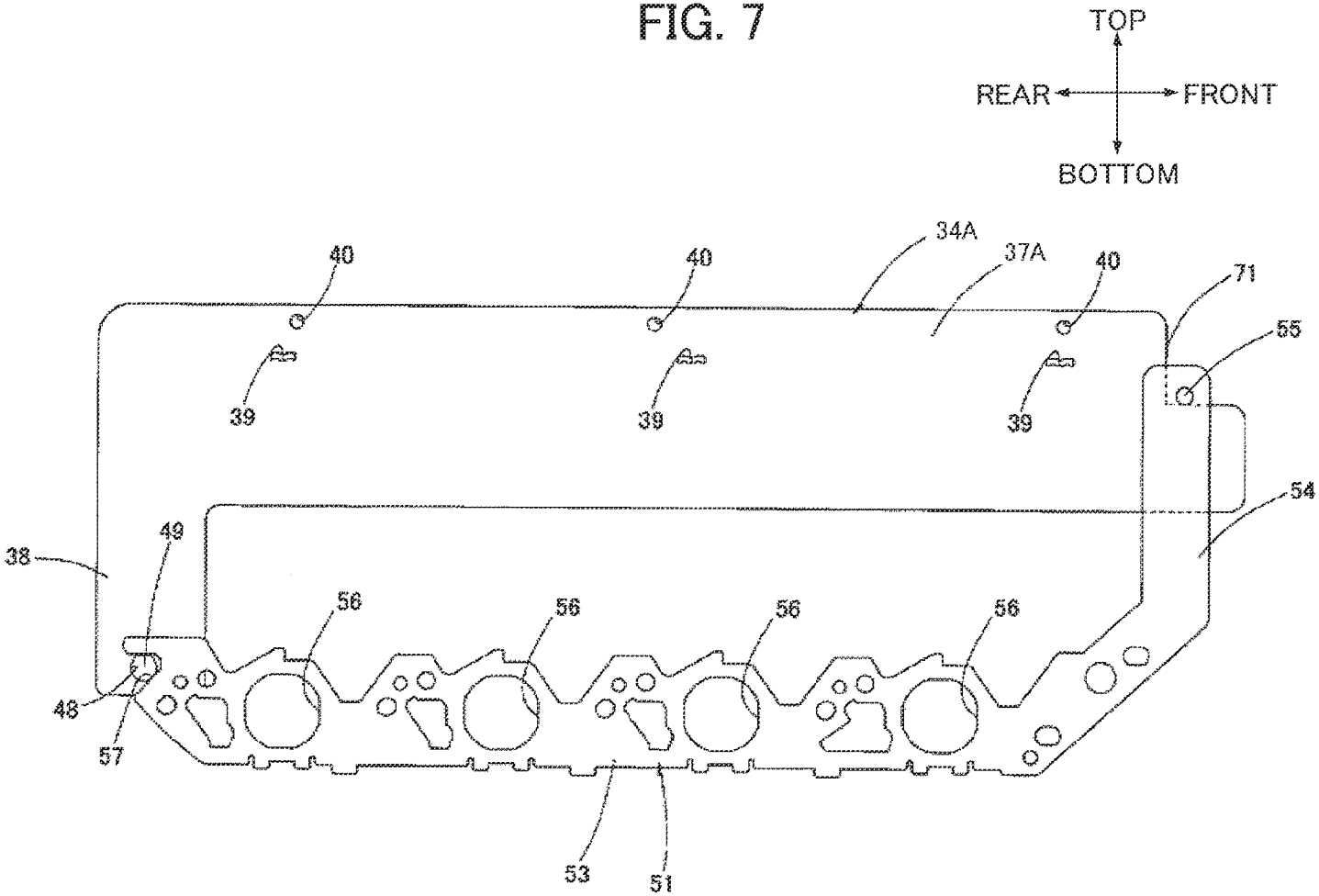
FIG. 7 is a side view as viewed from left side for description of positioning a drawer unit to an inner casing in a color printer according to a second embodiment of the present invention.

On the other hand, in the second embodiment shown in FIG. 7, a first primary portion 37A of a main side plate 34A has a front end portion provided with an engagement portion 71 functioning as the second positioning portion. The engagement portion 71 is provided by forming a rectangular notch positioned at an upper front corner portion of the first primary portion 37A. Each lateral end portion of the positioning shaft 55 is engageable with the engagement portion 71. Incidentally, the second extension portion 54 extends upward so that the positioning shaft 55 can be seated on the notch. Because of the engagement between the positioning shaft 55 and the engagement portion 71, the upper end portion of the second extension portion 54 can be subjected to positioning relative to the front end portion of the first primary portion 37A. Further, the second embodiment provides function the same as that of the first embodiment.

5. Third Embodiment

Figure 8:
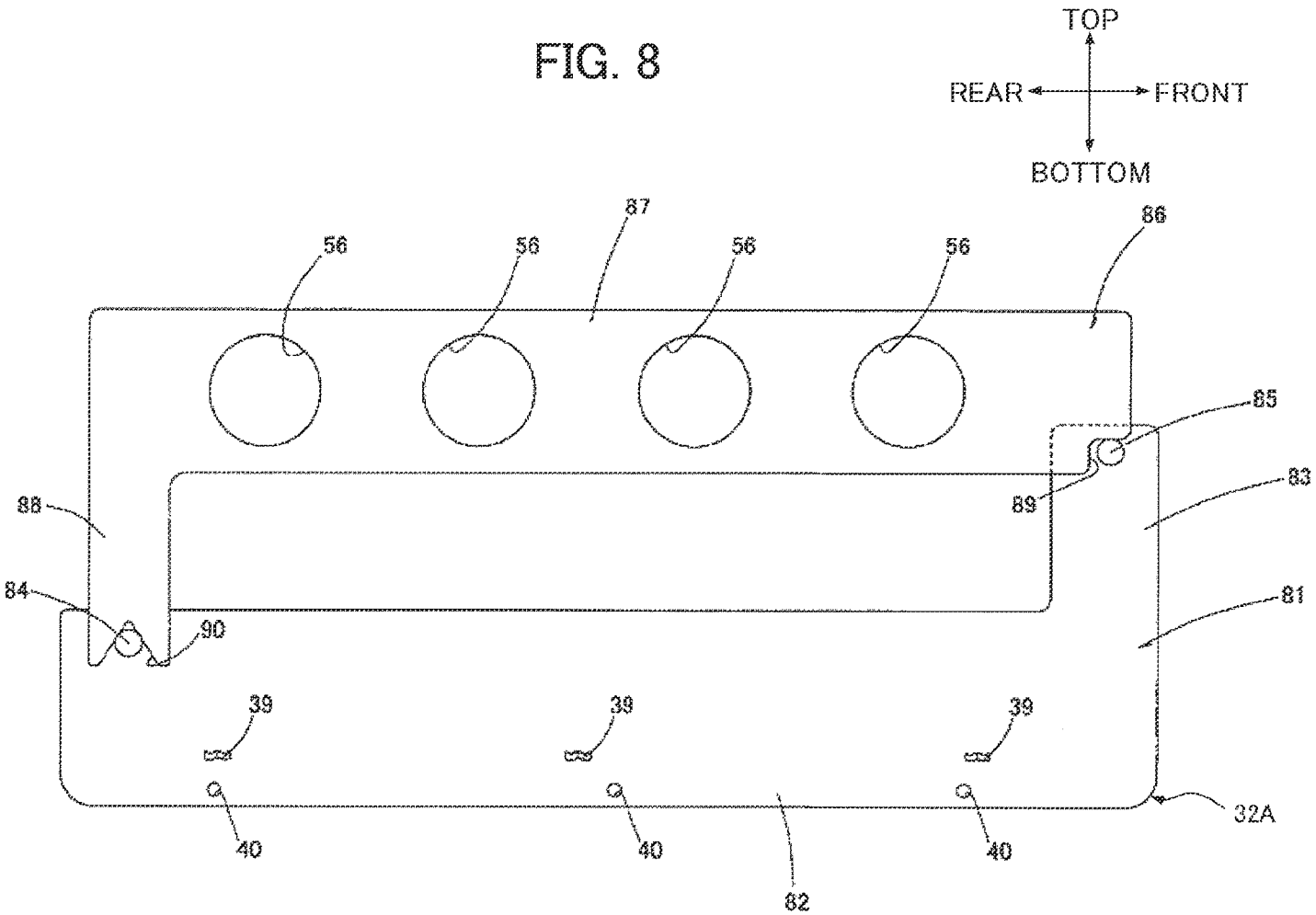
FIG. 8 is a side view as viewed from left side for description of positioning a drawer unit to an inner casing in a color printer according to a third embodiment of the present invention.

A color printer according to a third embodiment of the present invention will be described with reference to FIG. 8. In the foregoing embodiments, the scanner unit is positioned above and in confrontation with the process unit 9, and the process unit 9 can be pulled and pushed in frontward/rearward direction. On the other hand, in the third embodiment, a scanner unit is positioned below and in confrontation with a process unit, and the process unit can be attached to or detached from a main casing in a vertical direction. To this effect, a top cover (not shown) is provided at an upper wall of a main casing for an access to the process unit, (1) Structure The printer has an inner casing 32A of a main casing. The inner casing 32A includes a pair of main side plates 81 as first side plates. Incidentally, a scanner support plate (not shown) is spanned between lower end portions of the main side plates 81 for supporting the scanner unit (not shown).

The main side plates 81 are produced by punching and pressing a metal plate using identical punching-press die. Each main side plate 81 extends in frontward/rearward direction and has a front end portion bent upward to provide a generally L-shape in side view. That is, each main side plate 81 includes a first primary portion 82 and a first extension portion 83 integrally therewith.

The first primary portion 82 extends in frontward/rearward direction and has a generally rectangular shape and is spaced away from and below the photosensitive drums 12 in side view. A first base shaft 84 is spanned between rear end portions of the first primary portions 82.

Each first extension portion 83 extends upward from the front end portion of the first primary portion 82 and has a generally rectangular shape in side view. Each upper end portion of the first extension portion 83 is positioned frontward of a frontmost photosensitive drain 12, A second base shaft 85 is spanned between upper end portions of the first extension portions 83.

The process unit has a drawer unit including a pair of inner side plates 86 as second side plates. The inner side plates 86 are produced by punching and pressing a metal plate using identical punching-press die. Each inner side plate 86 extends in frontward/rearward direction and has a rear end portion bent downward to provide a generally L-shape in side view. That is, each inner side plate 86 includes a second primary portion 87 and a second extension portion 88 integrally therewith.

The second primary portion 87 extends in frontward/rearward direction and has a generally rectangular shape in side view. Further, the second primary portion 87 has a vertical length approximately equal to a diameter of the photosensitive drum. A notched portion 89 is formed at the front end portion of the second primary portion 87. More specifically, the notched portion 89 has a rectangular shape formed at a front lower end corner portion of the second primary portion 87, and is adapted to receive the second base shaft 85 from below when the process unit is accommodated in the main casing.

Each second extension portion 88 extends downward from the rear end portion of the second primary portion 87, and has a generally rectangular shape in side view, and is formed with a notched portion 90. The notched portion 90 is formed at the lower end portion of the second extension portion 88 and has a generally V shape such that an open end of the notched portion 90 is at the lower end surface of the second extension portion 88. The notched portion 90 is adapted to receive the first base shaft 84 from below when the process unit is accommodated in the main casing.

(2) Positioning of Process Unit

The front end portion of the process unit is subjected to positioning relative to the inner casing by fitting the front notched portion 89 with the second base shaft 85 from above. Further, the rear end portion of the process unit is subjected to positioning relative to the inner casing by fitting the rear notched portion 90 with the first base shaft 84 from above. That is, in the main side plate 81, the rear end portion of the first primary portion 82 through which the first base shaft 84 is inserted functions as a first positioning portion, and the upper end portion of the first extension portion 83 through which the second base shaft 85 is inserted functions as a second positioning portion.

Further, in the inner side plate 86, the lower end portion of the second extension portion 88 formed with the rear notched portion 90 functions as a third positioning portion subjected to positioning relative to the rear end portion of the first primary portion 82, and the front lower end portion of the second primary portion 87 formed with the front notched portion 89 functions as a fourth positioning portion subjected to positioning relative to the upper end portion of the first extension portion 83.

The first primary portion 82 and the second primary portion 87 are spaced away from each other in vertical direction so that these are not overlapped with each other, the upper end portion of the first extension portion 83 and the front end portion of the second primary portion 88 are overlapped with each other at a front side, and the rear end portion of the first primary portion 82 and the lower end portion of the second extension portion 88 are overlapped with each other at a rear side in side view.

(3) Attachment and Detachment of Process Unit

The process unit can be removed out of the main casing by opening the top cover (not shown) and by pulling the process unit upward. The process unit can be accommodated into the main casing by pushing the process unit downward into the main casing. Upon completion of the accommodation, the above-described positioning of the process unit with respect to the main casing can be attained. The third embodiment provides an advantage the same as that of the foregoing embodiments.

While the invention has been described in detail and with reference to specific embodiment thereof, it would be apparent to those skilled in the art that various changes and modifications may be made therein without departing from the scope of the invention.

What is claimed is:

1. An image forming device comprising:

a main casing;

a plurality of photosensitive bodies each defining a longitudinal direction, and arrayed with a space between neighboring photosensitive bodies in an array direction perpendicular to the longitudinal direction;

a photosensitive unit movable relative to the main casing and including the plurality of photosensitive bodies;

an exposure unit disposed in the main casing and confronting the photosensitive unit in a confronting direction perpendicular to the longitudinal direction and the array direction, the exposure unit being configured to expose the photosensitive bodies to light;

wherein the main casing comprises a first side plate supporting the exposure unit and having a first primary portion extending in the array direction, the first side plate also having a first positioning portion and a second positioning portion spaced away from the first positioning portion in the array direction;

wherein the photosensitive unit comprises a second side plate supporting the photosensitive bodies and having a second primary portion extending in the array direction, the second side plate also having a third positioning portion subjected to positioning relative to the first positioning portion, and a fourth positioning portion subjected to positioning relative to the second positioning portion, the first positioning portion and the third positioning portion being overlapped with each other at a first overlapped position and the second positioning portion and the fourth positioning portion being overlapped with each other at a second overlapped position, in the longitudinal direction while the first primary portion and the second primary portion being spaced away from each other, a distance between the second overlapped position and the exposure unit in the confronting direction being smaller than a distance between the first overlapped position and the exposure unit in the confronting direction.

2. The image forming device as claimed in claim 1, wherein the first side plate further includes a first extension portion extending integrally from the first primary portion toward the photosensitive bodies and provided with the first positioning portion; and wherein the second side plate further includes a second extension portion extending integrally from the second primary portion toward the exposure unit and provided with the fourth positioning portion.

3. The image forming device as claimed in claim 2, wherein the first primary portion and the first extension portion provide in combination an L-shape when viewing in the longitudinal direction.

4. The image forming device as claimed in claim 2, wherein the third positioning portion is engaged with the first positioning portion for relative positioning therebetween.

5. The image forming device as claimed in claim 2, wherein the fourth positioning portion is engaged with the second positioning portion for relative positioning therebetween.

6. The image forming device as claimed in claim 2, wherein the main casing has a positioning member for positioning the second positioning portion and the fourth positioning portion.

7. The image forming device as claimed in claim 1, wherein the first primary portion and the second primary portion are spaced away from each other in the confronting direction to provide a space, and the image forming device further comprises a power feed portion configured to supply electric power to the photosensitive unit, the power feed portion being provided at the main casing and positioned at the space.

8. The image forming device as claimed in claim 1, wherein the first primary portion and the second primary portion are spaced away from each other in the confronting direction to provide a space, and the image forming device further comprises a driving force input portion configured to supply driving force to the photosensitive unit, the driving force input portion being provided at the main casing and positioned at the space.

9. The image forming device as claimed in claim 1, wherein the photosensitive unit is movable in the array direction between an accommodated position in which the photosensitive unit is accommodated in the main casing and a draw-out position in which the photosensitive unit is moved away from the accommodated position.

* * * * *